US005177867A

United States Patent [19]

Danielsson

[11] Patent Number: 5,177,867

[45] Date of Patent: Jan. 12, 1993

[54] METHOD FOR FITTING A ROLL-RING TO A ROLL AXLE, AND A ROLL-RING MOUNT FOR CARRYING OUT THE METHOD

[75] Inventor: Kurt Danielsson, Smedjebacken, Sweden

[73] Assignee: Morgardshammar AB, Smedjebacken, Sweden

[21] Appl. No.: 623,999

[22] PCT Filed: May 2, 1990

[86] PCT No.: PCT/SE90/00287

§ 371 Date: Dec. 31, 1990

§ 102(e) Date: Dec. 31, 1990

[87] PCT Pub. No.: WO90/13371

PCT Pub. Date: Nov. 15, 1990

[30] Foreign Application Priority Data

May 3, 1989 [SE] Sweden ..... 8901597

[51] Int. Cl.[5] ..... B23P 19/00; B23P 19/04

[52] U.S. Cl. ..... 29/895.2; 29/525.1; 492/27; 492/45

[58] Field of Search ..... 29/122, 129, 895.2, 29/895, 525.1

[56] References Cited

U.S. PATENT DOCUMENTS 4,813,113 3/1989 Wykes et al. ..... 29/122

4,881,310 11/1989 Wykes et al. ..... 29/122

*Primary Examiner*—Timothy V. Eley

*Attorney, Agent, or Firm*—Young & Thompson

[57] ABSTRACT

A method for securing a roll-ring onto the end of a roll-axle, comprising prefitting a roll-ring onto a roll-ring mount, and securing the mount with the roll-ring fitted thereon, onto the end of a roll axle. Securement is effected by passing one single screw-threaded bolt axially through an opening through the roll-ring mount, and tightening the bolt into a screw-threaded recess within the end of the roll-axle. The mount has a cylindrical end part (22) on which a roll-ring (30) can be secured, and the mount has an abutment surface (24) against which a roll-ring is to be pressed. Clamping structure (27, 28) presses the roll-ring against the abutment surface, and projections and recesses (25, 29, 31, 34) non-rotatably secure the mount to an end of a roll-axle. The end of the roll-axle has a conical recess in which a conical external surface on the roll-ring mount shape-matingly fits.

9 Claims, 2 Drawing Sheets

METHOD FOR FITTING A ROLL-RING TO A ROLL AXLE, AND A ROLL-RING MOUNT FOR CARRYING OUT THE METHOD

The present invention relates to a method for fitting a roll-ring onto a roll axle, and a roll-ring mount for carrying out the method.

A rod mill comprises roll units in which pairs of rolls are arranged alternately with horizontal and vertical axle directions. The rolls in each of the roll pairs have the form of replaceable roll rings mounted on the free ends of rotationally-driven roll axles.

The roll rings are normally made of cemented carbide material or hardmetal, which due to its limited tensile strength tends to crack when subjected to excessively high tensile loads. In order to avoid the formation of cracks, the roll rings are normally clamped on the roll axles between a shoulder provided on said axle and a clamping plate, with a clamping force such that the frictional forces acting between the sides of the roll-ring and the abutment surfaces of the clamping plate and the shoulder on the roll-axle respectively are sufficiently great to ensure that the roll-ring will be rotated positively by the roll axle.

A known roll-ring fitting tool or mount will now be described with reference to FIG. 1.

The end of the roll-axle 1 illustrated in FIG. 1 has a conical surface 2 and an inner shoulder 3. The illustrated roll-ring 4 is fitted to the axle in the following manner. A centering ring 4' is fitted into the ring-opening of the roll-ring 4. The roll-ring assembly 4, 4' is then fitted onto the conical surface 2 of the roll axle, so that the roll-ring is in abutment with the shoulder 3. A press-ring 5, followed by a cup spring 6 and an internally screw-threaded ring 7 is then fitted onto the roll-axle and the ring 7 screwed onto a screw-threaded part 8 thereof. A press tool 9 is then screwed onto the outer screw-thread 10 of the roll-axle. Pressure fluid is now supplied to the press tool, through a nozzle 11, whereupon the edge of the press tool will exert an axial pressure on the periphery of the cup spring 6, so as to apply a controlled axial pressure-force on the roll-ring 4, which is consequently clamped between the shoulder 3 and the press ring 5. Subsequent to this application of pressure, the ring 7 is screwed into abutment with the cup spring 6, with the aid of a tool 12. The press tool 14 can then be relieved of pressure and removed.

The roll-ring 4 is removed from the roll-axle in the reverse order. The assembly comprising the roll-ring 4 20 and the centering ring 4', however, will remain clamped against the conical surface 2 of the roll-axle even when the pressure exerted by the cup spring 6 has been removed, and it is therefore necessary to supply pressure fluid to a nozzle 13 on the roll axle, in order to loosen the roll-ring assembly.

It will be observed that the components of the roll-ring mount illustrated in FIG. 1 must be manufactured with relatively high precision, since it is necessary for the roll-ring to fit accurately on the roll axle, so as to be able to achieve the high roll-pressure necessary in a roll pair.

A further roll-ring mount based on similar principles is known from SE Patent Specification 7703169-8. The mount taught by this specification also requires the roll-ring to be clamped between a shoulder and a ring with the aid of a spring compressed by means of a hydraulic tool and held in a compressed state by means of a screw-threaded annulus, which is screwed into abutment with the compressed spring.

It will be evident from the above description of the aforesaid roll-ring mount that the mount has a relatively complicated construction and that the work of fitting roll-rings is time consuming, which means long non-productive periods of the rod mill caused by roll-ring changes, since finished products are in modern times manufactured in small series, in order to reduce storage time.

The object of the present invention is to provide a roll-ring fitting method which will reduce the idle time of a rod mill, and also to provide a roll-ring mount for carrying out the method. This object is achieved in accordance with the invention with a method for fitting a roll-ring onto the end of a roll-axle which is characterized by the steps of pre-fitting the roll-ring to a roll-ring mount and attaching said device carrying said roll-ring to the end of the roll axle, subsequent, when necessary, to first having removed a previously fitted roll-ring mount carrying a roll-ring from said axle end.

A preferred, inventive roll-ring mount for carrying out the invention is characterized in that said device includes a cylindrical end-part on which a roll-ring can be fitted, an abutment surface against which a first side of the roll-ring is intended to be pressed, a clamping means for pressing said first side of the roll-ring against said abutment surface with a predetermined clamping force, and means for achieving rotationally-rigid attachment of the device to the end of the roll axle, said end being configured to coact with said means.

Because the roll-ring is pre-fitted to the roll-ring mount, the work entailed in replacing a roll-ring can be reduced to the steps of dismantling a previous roll-ring mount and fitting a new roll-ring mount. This enables the exchange of roll-rings to be completed very quickly, in about 10 seconds, as compared with the time taken when using previously known roll-ring mounts (about 2–3 minutes), resulting in considerable reduction in mill idling times occasioned by the replacement of roll-rings, with consequent reduced production costs.

The roll-ring mount is of simple construction and does not require the same high degree of precision in manufacture as the components of the earlier known roll-ring mounts, and consequently the manufacturing costs of the roll-ring mount are also comparatively low.

Because, when applying the inventive method, the time taken to replace a roll-ring is comparatively short, roll-rings having only one single roll groove can be used, thereby enabling improved use of the expensive hardmetal material from which the roll rings are made, which in turn signifies considerable savings in cost. Furthermore, subsequent grinding of a roll-ring can be carried out while the ring is secured on the roll-ring mount, which enables precise centering of the roll-ring and precise linearity of the roll-groove to be achieved. In accordance with one preferred embodiment of the invention, the means for rotationally-rigid attachment of the mount to the end of a roll-axle is configured to fit a conventional grinding machine.

The invention also relates to a roll-axle intended for coaction with an inventive roll-ring mount.

So that the invention will be more readily understood and further features thereof made apparent, the invention will now be described with reference to a preferred embodiment of the invention illustrated in the accompanying drawings, in which.

Figure 1:
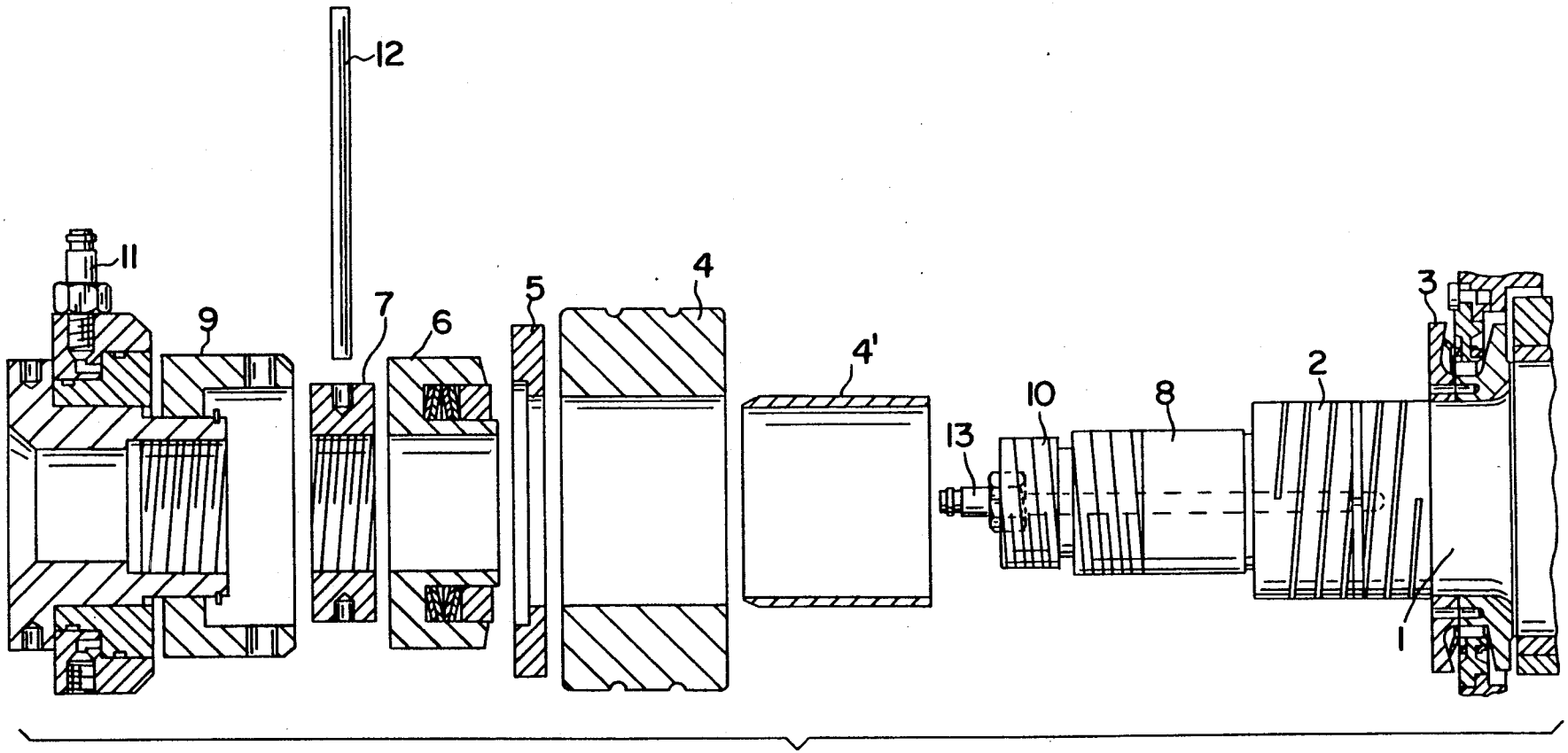
FIG. 1 PRIOR ART
FIG. 1 illustrates a known roll-ring mount.
Figure 2:
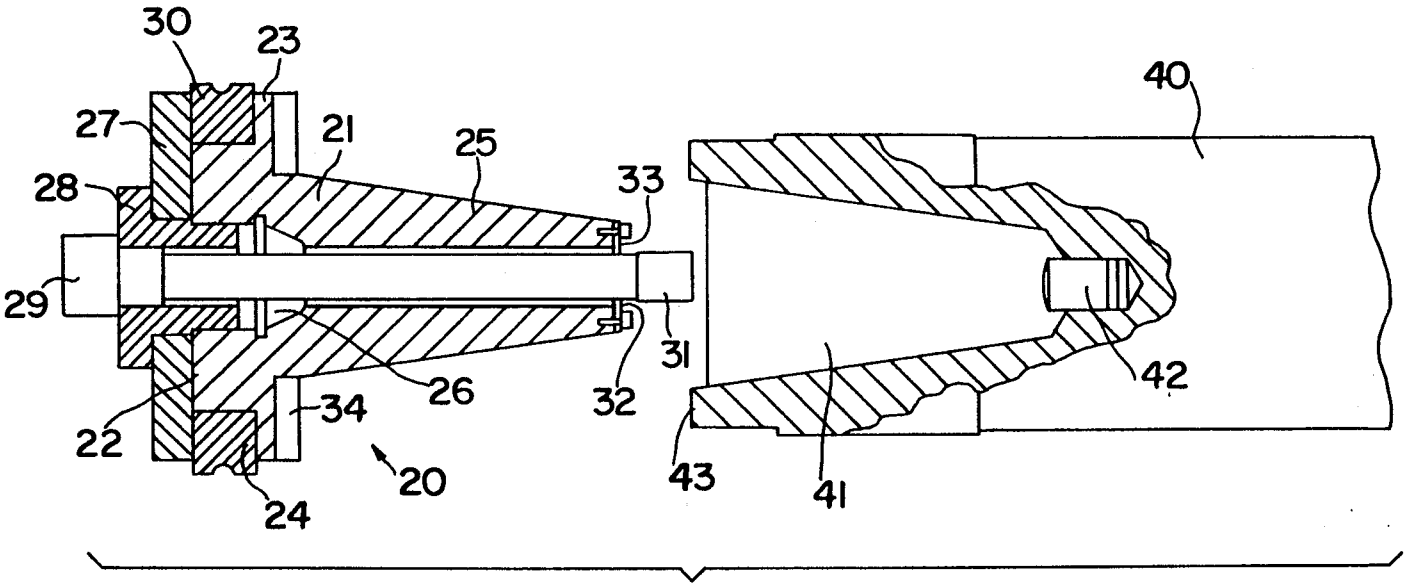
FIG. 2 is an axial cross-sectional view of one embodiment of an inventive roll-ring mount and a roll axle, partly in cross-section, with which the roll-ring mount is intended to coact.

FIG. 2 illustrates a roll-ring mount 20 constructed in accordance with one embodiment of the invention, a roll-ring 30 fitted to the mount, and a roll-axle 40 in which one end of the mount 20 can be fitted.

The mount includes a body 21 having a first, cylindrical end 22 on which the roll-ring 30 can be mounted with a frictional fit, a collar 23 provided with an abutment surface 24 for abutment with a roll-ring fitted on the mount, and a second, conical end-part 25. Extending through the body 21 is a central bore 26 which has a constant diameter along the major part of the conical end-part 25 of said body 21 and then widens to a larger diameter, this larger diameter of said bore extending along the whole of the first end-part 22. This region of larger diameter of said bore 26 is screw-threaded. A hollow screw 28 having an external screw-thread complementary to the screw-thread of the widened part of the bore 26 is operative to firmly hold a clamping disc 27. The hollow or hole through the screw 28 has the same diameter as that part of the bore 26 extending along the conical end-part of said body, and is in line with this part of said bore. A bolt 29 is insertable through the hollow in the screw 28 and through the bore 26. When the bolt 29 is inserted, a screw-threaded part 31 of the bolt extends beyond the end surface of the conical end-part 25 of the body 21.

In order to ensure that the bolt 29 will be centered when inserted into the bore, the roll-ring mount will also preferably include two semi-circular guide plates 32,33 which encircle the stem of the bolt.

FIG. 2 also shows one end of a roll-axle 40 which, in accordance with the invention, includes a cavity 41, whose shape is complementary with the shape of the conical-end part 25 and in the bottom of which there is provided a screw-threaded hole 42 into which the screw-threaded end 31 of the bolt 29 can be screwed. The screw-threaded hole is preferably provided in said end of the roll-axle by means of an internally screw-threaded sleeve 42 which is inserted in and secured in the bottom of the cavity 41 in some suitable manner.

The outer end of the roll-axle is configured with two diametrically opposed pegs 43 which when the roll-ring mount 20 is inserted into the cavity 41 engage complementary grooves 34 or recesses formed in the collar 23.

According to the invention, the roll-ring is prefitted to the roll-ring mount. Thus, the work of fitting a roll-ring to a roll-axle simply entails the insertion of the mount 20 into the cavity 41 followed by tightening of the bolt 29, subsequent to having first dismantled a previously fitted mount, when necessary. The inventive method thus enables a roll-ring change to be carried out very quickly, thereby greatly reducing the idle time of a rod mill occasioned by replacement of a roll-ring. The inventive method also provides the advantage of enabling roll-rings to be fitted to roll-ring mounts in any desired workshop location and over any period of time, without needing to subject the fitter to stress, thereby enabling the roll-rings to be fitted to a high degree accuracy and with the aid of special equipment if so required, and by one skilled person or a few skilled persons.

As will be evident from the following, the roll-ring can be fitted in conjunction with the final or subsequent working of roll-rings.

A roll-ring 30 is fitted to the roll-ring mount described with reference to FIG. 2 preferably in the following manner. The roll-ring 30 is first friction fitted onto the cylindrical end-part 22 of the body 21, whereafter the screw 28 with the clamping-plate 27 fitted thereon is screwed into the screw-threaded hollow of the end-part 22. The conical end-part 25 of the body 21 is then inserted into a recess whose shape corresponds to the shape of the recess 41 of the roll-axle 40, said recess being configured in an anvil device or like counter-pressure device. An appropriate press-tool operative to exert pressure against the periphery of the clamping-plate 27 is then activated and a predetermined pressure is applied to the clamping plate, and therewith also to the mount. The screw 28 is then screwed into abutment with the clamped clamping-plate, so as to hold the plate in its clamped position. The press-tool is then removed and the assembly comprising the body 21, the clamping arrangement 27, 28 and the roll-ring 30 is removed from the cavity in said anvil device. The bolt 29 is then inserted into said assembly and the semi-circular guide-plates 32,33 are fastened to the end of the conical end-part part 25 of the body 21. As shown in FIG. 2, the threaded bolt-end 31 has a slightly larger diameter than the bolt-stem, and hence the guide plate 32, 33 will prevent the bolt 29 from falling out of the mount. It will also be seen that when removing a roll-ring mount from a roll shaft, the outer screw-thread of the bolt-part 31 will exert an outwardly directed force on the body 21 as the bolt is unscrewed, therewith ensuring that the mount will loosen from the roll axle.

As will be understood, it is also possible to insert the bolt 29 and secure the guide plates 32, 33 prior to applying the press tool, although this involves the additional steps of screwing-in and unscrewing the bolt 29 when the cavity in the anvil device includes a screw-threaded hole corresponding to the screw-threaded hole 42 of the roll axle. This variant is suitable, however, when the roll-ring is to be finally machined after being fitted and the anvil device consists of the shaft of a machine tool, preferably a grinding machine, since the bolt 29 then need only be tightened upon completion of clamping the roll-ring in order for the roll-ring to be fitted to the tool.

In this connection it should be observed that roll-rings are normally re-ground a number of times during their useful life, and consequently it is of significant advantage that the inventive roll-ring mount is configured in a manner which enables the mount to be fitted to conventional grinding machines and that the roll-ring can be re-ground without needing to remove the ring from the mount.

It is, of course, also possible to clamp the roll-ring without the aid of a press tool, by tightening the screw 28 to a predetermined torque setting.

Thus, the invention provides a method which enables roll-rings to be replaced very quickly and simply, without requiring the need for expert personnel to effect such replacement. The components forming part of the roll-ring mount by means of which the method is carried out are of simple construction and can be manufactured without high demands on precision in manufacture.

It will be understood that the described roll-ring mount merely constitutes a preferred embodiment of the invention and that the mount can be modified in several ways within the scope of the invention, particularly with respect to its clamping arrangement and the arrangement by means of which the mount is non-rotatably fastened to the end of a roll axle. It will also be understood that, for instance, it is not necessary to configure the mount so that it can be fitted directly to a machine tool, since the mount can be configured so as to enable it to be attached to a machine tool with the aid of a suitably constructed coupling device, and it will also be obvious that the constructional detail of the illustrated roll-ring mount is not restricted to carrying out the inventive method. Consequently, the invention is only limited by the subject matter of the following claims.

I claim:

1. A method for securing a roll-ring onto the end of a roll-axle, comprising prefitting a roll-ring onto a roll-ring mount having thereon an abutment surface transverse to the axis of the roll ring, clamping the roll-ring against said abutment surface, and securing the mount with the roll-ring fitted thereon, onto the end of a roll axle.

2. A method as claimed in claim 1, in which said securing is effected by passing one single screw-threaded bolt axially through an opening through said roll-ring mount, and tightening said one single bolt into a screw-threaded recess within said end of said roll-axle.

3. A roll-ring mount comprising a cylindrical end part (22) on which a roll-ring (30) can be secured, said mount having an abutment surface (24) against which a said roll-ring is to be pressed clamping means (27, 28) securable to said mount to press said roll-ring against said abutment surface, and means (25, 29, 31, 34) for non-rotatably securing the mount to an end of a roll-axle.

4. A roll-ring mount as claimed in claim 3, in combination with a said roll-axle, said end of said roll-axle and said securing means having mutually engaging surfaces of complementary configuration.

5. A roll-ring mount as claimed in claim 4, said end of said roll-axle having a conical recess in which a conical external surface on said roll-ring mount shape-matingly fits.

6. A roll-ring mount as claimed in claim 3, said clamping means (27, 28) comprising a clamping plate (27) adapted to contact a said roll-ring (30) on a side of said roll-ring (30) opposite said abutment surface (24), and a screw-threaded clamping element (28) that screws into said cylindrical end part (22) to hold said clamping plate (27) against a said roll-ring (30).

7. A roll-ring mount as claimed in claim 4, wherein said mount and said end of said roll-axle have interfitting recesses and projections to prevent rotation of said mount and said roll-axle relative to each other.

8. A roll-ring mount as claimed in claim 3, in combination with a said roll-axle, said roll-ring mount having an opening (26) having an axial opening therethrough, and one single screw-threaded bolt that passes through said opening and is threaded into a screw-threaded opening in said end of said roll-axle to hold said mount and axle together.

9. A roll-ring mount as claimed in claim 8, further comprising two guide plates (32, 33) removably secured to said mount on opposite sides of said opening (26) through said mount, said bolt (29) having a screw-threaded end portion (31) of larger diameter than the distance between said plates (32, 33) and protruding from the mount beyond said plates thereby to hold the bolt against accidental removal from the mount.

* * * * *